US006189780B1

(12) United States Patent
Kanter

(10) Patent No.: US 6,189,780 B1
(45) Date of Patent: Feb. 20, 2001

(54) DISPLAY CONTAINER HAVING INTEGRAL REINFORCEMENT

(76) Inventor: Allen Kanter, 1042 Gypsy Hill Rd., Gwynedd Valley, PA (US) 19437

( * ) Notice: Under 35 U.S.C. 154(b), the term of this patent shall be extended for 0 days.

(21) Appl. No.: 09/541,334

(22) Filed: Apr. 3, 2000

(51) Int. Cl.[7] ..... B65D 5/54
(52) U.S. Cl. ..... 229/242; 229/164; 229/240
(58) Field of Search ..... 229/164, 240, 229/241, 242; 206/736, 746

(56) References Cited

U.S. PATENT DOCUMENTS 1,671,566 * 5/1928 Baldwin ..... 229/241
3,315,875 * 4/1967 Praetorius ..... 229/242
3,349,959 * 10/1967 Watkins ..... 229/241
4,318,474 * 3/1982 Hasegawa ..... 229/242
4,946,042 * 8/1990 Ferreri et al. ..... 229/241
5,193,740 * 3/1993 Newborough et al. ..... 229/242
5,277,360 * 1/1994 DeMott ..... 229/164
5,950,914 * 9/1999 Dunton et al. ..... 229/164
5,957,294 * 9/1999 Kanter ..... 229/241
5,979,749 * 11/1999 Bozich ..... 229/242

* cited by examiner

*Primary Examiner*—Gary E. Elkins
(74) *Attorney, Agent, or Firm*—Synnestvedt & Lechner LLP

(57) ABSTRACT

A container assembly having a removable display panel formed in a wall panel defined by a separation line along which the display panel is separable from the remainder of the wall panel. A reinforcing panel is secured to the inner face of the wall panel and positioned to overlap at least a portion of the separation line and reinforce the wall panel. The reinforcing panel itself has a separation line along which a removable section is separable from a remainder section. In this manner a section of the reinforcing panel can be removed with the removal of the display panel.

19 Claims, 4 Drawing Sheets

FIG.3
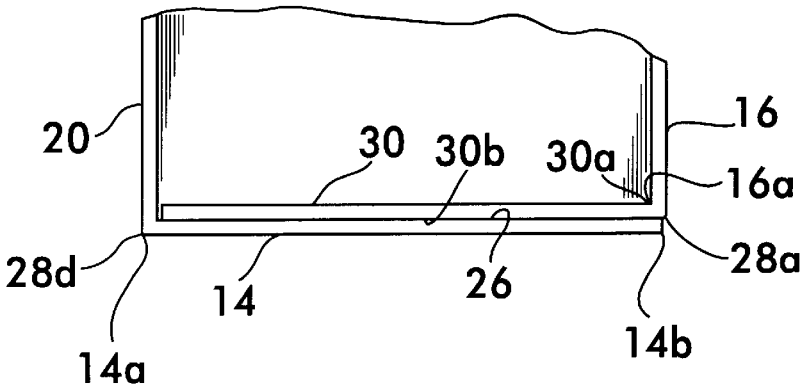
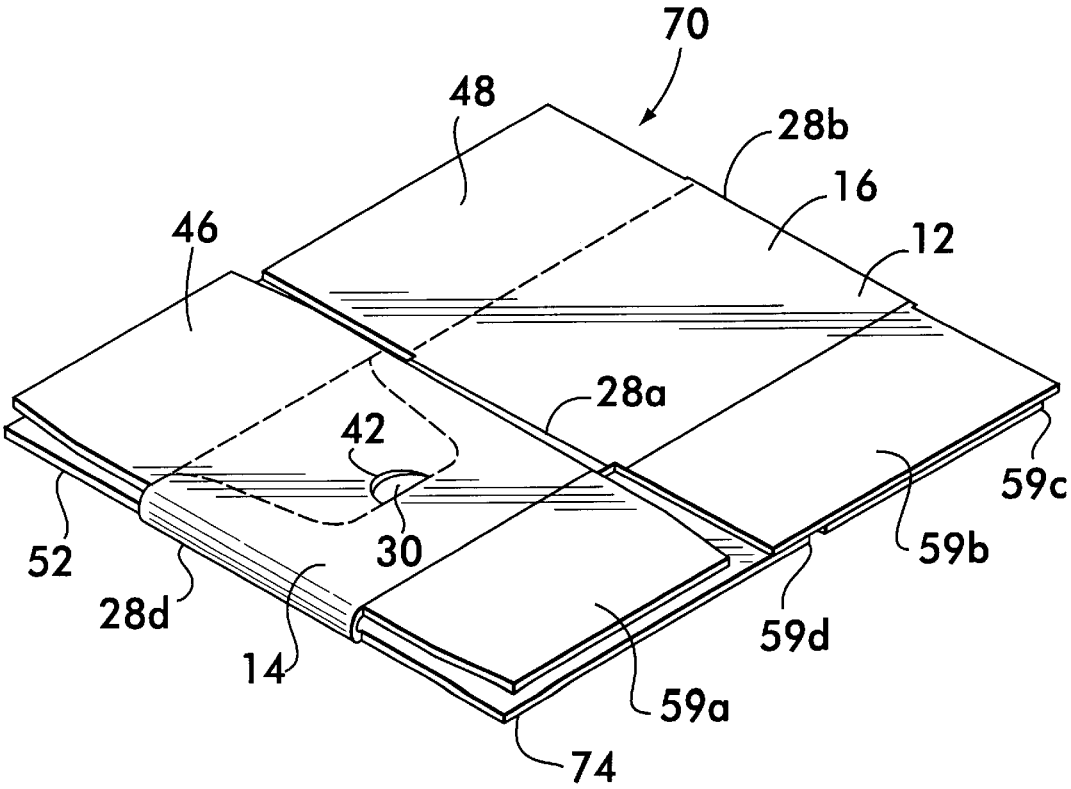
FIG.4

DISPLAY CONTAINER HAVING INTEGRAL REINFORCEMENT

BACKGROUND OF THE INVENTION

1. Field of the Invention

The present invention relates to containers made from paperboard, and more particularly to stackable containers used for both shipping and display and which have a removable display section.

2. Description of the Related Art

Corrugated containers are widely used to both ship and display goods such as food and candy items. The practice of displaying goods in shipping containers has become more popular with the advent of large warehouse style stores and supermarkets where the containers are stacked one on top of another on the retail floor.

A popular type of display container has one or more removable sections or panels typically defined by perforated tear lines. Such containers are generally formed from a one piece blank suitably cut, scored, and perforated to enable subsequent folding of the blank into the final closed container. After receiving the packaged goods, the retailer removes the display section from the container to provide access to the goods within even when the container is stacked.

A major consideration in design of such containers is its compression or stacking strength. Containers may collapse or become misshaped under the weight of the containers stacked on top. The inclusion of perforation lines to permit easy separation of the display panel reduces the structural integrity and compression strength of the container. The stress of stacking a large number of containers on top of each other may cause inadvertent opening or bending of the container along the perforation lines, and result in failure or collapse of the container. This destroys the aesthetic appearance of the container and damages the products within.

Tall stacks of containers are necessary to maximize utilization of cargo, warehouse, and retail floor space. Thus the problem has been to balance the maximization of compressive strength of the container against the economizing of the material and manufacturing costs to manufacture the container.

A further consideration is the compatibility of the containers with automated manufacturing and packaging equipment. Containers are typically made on automated production lines. Any suitable container design or modification to improve the strength of a container should be compatible with such production equipment. Furthermore, the packagers typically use automated packaging lines which assemble the container from a flat knockdown state and load the container with goods prior to the container being closed. Any method of reinforcing a container should not interfere with automated packaging equipment.

One advantageous type of container is disclosed in U.S. Pat. No. 5,957,294 to Kanter. This type of container has an insert added behind the container wall that has the removable display sections. The insert adds stacking strength by reinforcing the display panel which has been weakened by the perforations that define the display section. The insert is removed after the display container is opened. Alternatively, the insert can have a pattern of perforations matching that of the perforated container wall it reinforces. These containers, however, use an insert that is added during the construction process and thus involves separate steps to cut the insert and to combine the insert panel with the container. Cost reductions could be gained if these steps could be eliminated.

Accordingly, one object of the present invention is to provide a shipping/display container having improved compression and stacking strength.

Another object of the present invention is to provide a container having a reinforcement panel compatible for use with automated packaging equipment.

A still further object of the present invention is to provide a display container having improved stacking strength that is economical to make and requires minimal additional material.

Another object of the present invention is to provide a display container that will not buckle or open along the perforated tear line for the display panels.

Additional objects, advantages and novel features will be set forth in part in the description which follows, and in part will become apparent to those skilled in the art upon examination of the following or may be learned by practice of the invention. The objects and advantages of the invention may be realized and attained by means and the elements in combinations particularly pointed out in the appended claims.

SUMMARY OF THE INVENTION

The present invention provides an improved shipping/display container. Broadly, the invention provides a container assembly having multiple side panels attached to one another for forming the sides of the container. The multiple side panels include a first side panel that has an inner face facing the interior of the container and a top edge, and a second side panel adjacent to the first side panel. A removable display panel is formed in the first side panel. The removable display panel has an upper edge which is defined by at least a portion of the top edge of the first side panel and is further defined by a first separation line along which the display panel is separable from the remainder of the first wall panel. A container top includes a first top flap that is integrally attached to the upper edge of the first side panel. A removable top section is provided which includes at least a portion of the first top flap. This removable top section is integrally attached to the upper edge of the removable display panel. At least one bottom forming flap is provided for forming the bottom of the container. Integrally attached to the second side panel and secured to the first side panel is a reinforcing panel. The reinforcing panel has a second separation line separating a removable section of the reinforcing panel from a remainder section. The remainder section of the reinforcing panel is secured to the first side panel.

The separation lines form a line of relative weakness in the container which allows easy tearing or separation of the various sections. As discussed more fully below, the separation line preferably comprises a series of perforations or cuts in the container. The insert is provided to reinforce the container where weakened due to the separation line.

BRIEF DESCRIPTION OF THE DRAWINGS

The foregoing summary and the following detailed description may be better understood when read in conjunction with the accompanying drawings. For the purpose of illustrating the invention, two preferred embodiments are shown in the drawings. It is understood, however, that this invention is not limited to the precise arrangements or configurations shown.

FIG. 3 is a view taken along line 3—3 as shown in FIG. 2;

FIG. 4 is a perspective view of the container of FIG. 1 shown in the knockdown state.

DETAILED DESCRIPTION OF THE INVENTION

Figure 1:
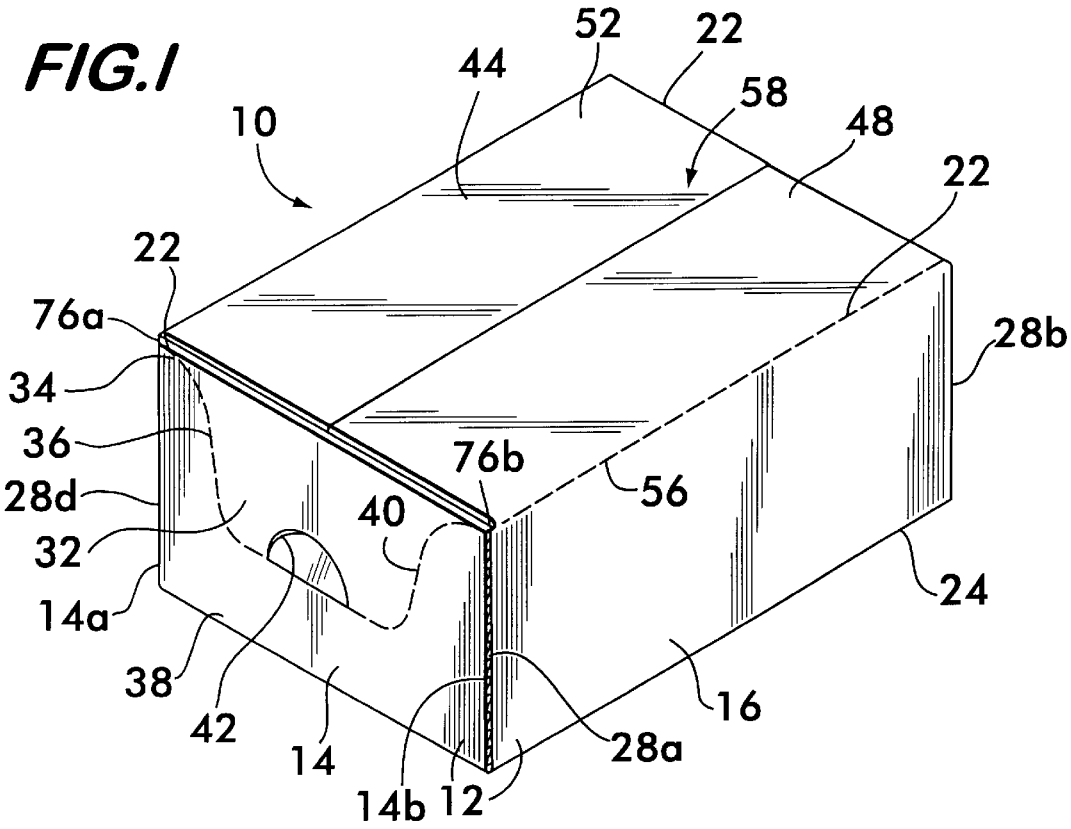
FIG. 1 is a perspective view of a container assembly in accordance with the present invention shown in an assembled closed state.

Described below is an embodiment particularly suited for use as a shipping and display container. It is readily understood, however, that the present invention can be adapted to containers used for other purposes.

Reference is now made to a preferred embodiment of the invention illustrated in FIGS. 1, 1A, 2, and 3 showing a shipping/display container assembly 10 in its fully assembled/closed state. The container 10 has multiple side panels 12 integrally attached to one another as shown, and which includes a first side panel 14, a second side panel 16, a third side panel 18, and a fourth side panel 20. Each of the multiple side panels 12 has a top edge 22, a bottom edge 24, and an inner face 26 facing the interior of the container 10. The container side panels are attached to one another at corners 28*a*, 28*b*, 28*c* and 28*d*. The container side panels 14, 18, and 20, are integrally connected to one another as shown at corners 28*b*, 28*c*, and 28*d*. Side wall panels 14 and 16 are connected to form the corner 28*a* through a reinforcing panel 30 having an end 30*a* integrally connected to an end 16*a* of the second side panel 16, and which has a face 30*b* adhesively secured to the inside face 26 of the first side panel 14 using an adhesive such as glue as known in the art. See FIG. 3. The reinforcing panel 30 acts as a large glue tab for connecting the side panels 14 and 16 to form the corner 28*a*. Preferably, the reinforcing panel 30 is substantially the same height and width of the first side panel 14. The reinforcing panel 30 provides an additional support wall adjacent the first side panel 14 which is weakened due to the perforations, and thereby increases the weight that the first side panel 14 can support. Moreover, the reinforcing panel 30 helps protect the first side panel 14 from bending and opening along the separation line 36.

A removable display panel 32 is formed in the first side panel 14. It has an upper edge 34 defined by at least a portion of the top edge 22 of the first wall panel 14, and is further defined by a separation line 36 extending between opposite sides 14*a* and 14*b* of the top edge 22 of the first side panel 14 to divide the first side panel 14 into two sections—the display panel 32, and a remainder panel 38.

The separation line 36 is curved to form the display panel 32 of the desired shape and size. The separation line 36 forms a line of relative weakness allowing easy tearing or separation of the various sections. The separation line 36 preferably comprises a series of perforations 40 or cuts through the panel 14, with uncut lengths between each perforation. Suitable perforations include perforations of one-half inch in length, with uncut lengths in between the perforation of about three-sixteenths of an inch, another pattern being a ¼ inch perforation followed by ⅛ inch uncut section. The perforations can be curved as shown. Any suitably dimensioned perforation may be used, as well as any suitable type of separation line. A hand opening 42 is provided for easy grasping and removal of the display panel 32 as further described below.

The reinforcing panel 30 includes a removable section 62 and a remainder section 64 separable from one another along a second separation line 66. See FIG. 5. The removable section 62 is preferably the same size and configuration as the display panel 32 with the second separation line 66 configured to match the curvature and position of the first separation line 36 so that the removal of the display panel 32 and removable section 62 leaves a uniform and aesthetic display opening through both the first side panel 14 and reinforcing panel 30 as shown if FIG. 2. As the remainder section 64 of the reinforcing panel 30 remains after the removable section 62 is removed, the remainder section 64 is adhesively secured to the inner face 26 of the first side panel 14 to form the corner 28*a* as discussed above. Sufficient glue should be used to maintain the remainder section 64 adjacent the first side panel 14 while still allowing the removable section 62 to be broken away and removed.

A container top 44 includes a first top flap 46, a second top flap 48, a third top flap 50 and a fourth top flap 52, each being integrally attached to the upper edge 22 of respective side panels 14, 16,18 and 20 as shown.

Figure 2:
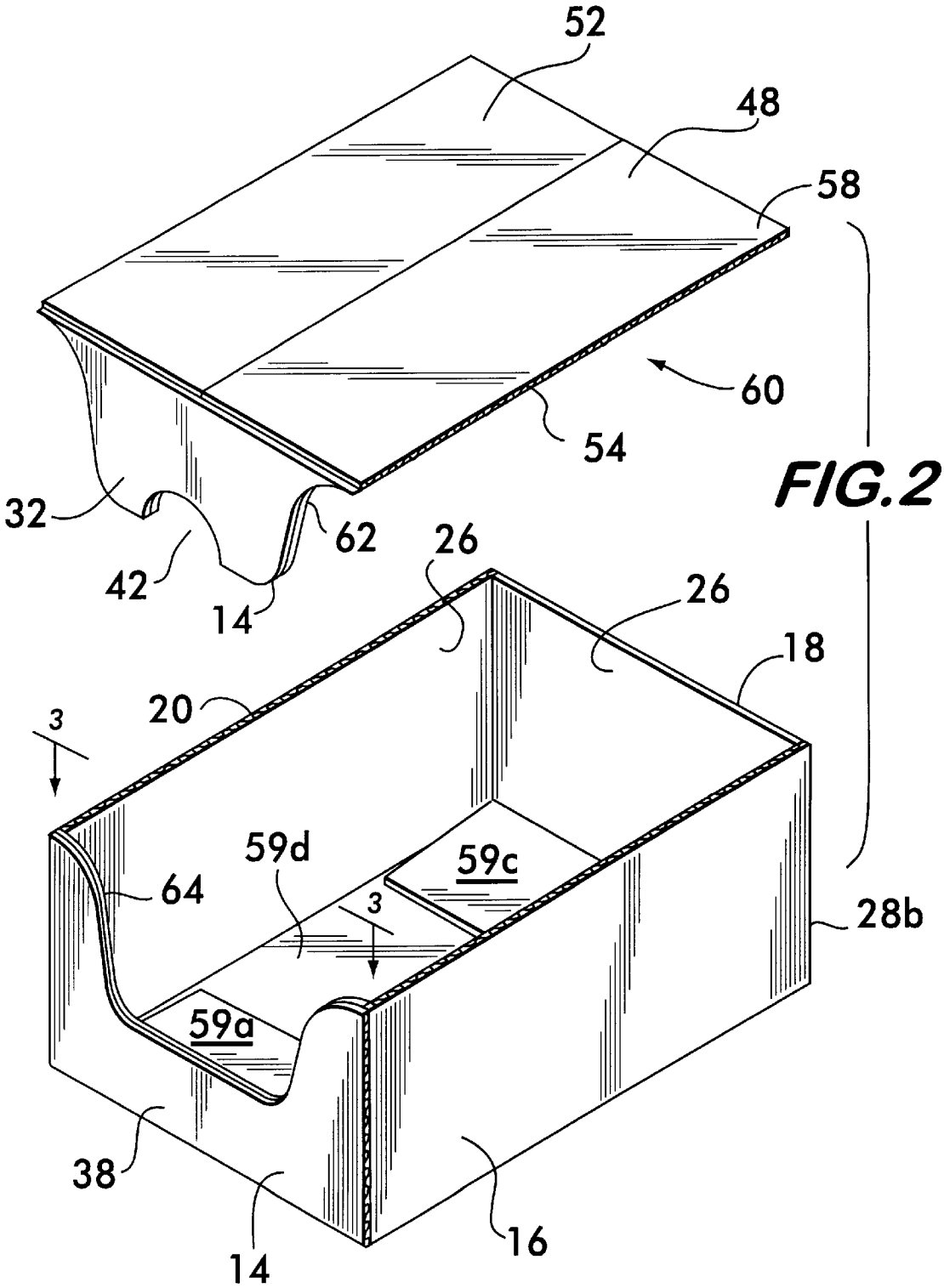
FIG. 2 is a perspective view of the container of FIG. 1 showing the removable section removed.

A removable top section 54 allows access through the top of the container 10 as seen in FIG. 2. The removable top section 54 includes at least a portion of the first top flap 46 which is integrally attached to the upper edge 34 of the display panel 32. In the present embodiment, the removable top section 54 includes the entire first top flap 46 and further includes the second, third and fourth top flaps, 48, 50 and 52. (See FIG. 2). A third separation line 56 is positioned between each of the second, third, and fourth top flaps 48, 50, 52 and the side panels 16, 18 and 20 to which they are attached. The top flaps 48, 50, 52 are separable from the container 10 along the separation line 56. It is seen that the third separation line 56 extends around the top edges 22 of the second, third and fourth side panels 16, 18, 20 and has end portions 76*a*, 76*b* joining the first separation line 36 (joining as used herein does not mean contacting, but that one separation line comes close enough to the other such that the separation process can continue from one separation line to the other). The separation line 36 preferably comprises a series of perforations as previously described above.

When the container assembly 10 is in its fully assembled and closed state as shown in FIG. 1, the first, second, third, and fourth flaps 46, 48, 50, 52 have been folded and glued to one another as known in the art to form a closed container top 58 as seen in FIG. 1. As seen in FIG. 2, the display panel 32 and the closed container top 58, integrally connected along the upper edge 34 of the display panel 32, is separable from the container 10 as a single removable unit 60 (the display panel 32 and the removable top section 54) along the first and third separation lines 36, 56. To accomplish this, the display panel 32 is grasped at the opening 42 and pulled upward away from the container 10, tearing the container along the first separation line 36. The container top 58 is then pulled back to tear the container along the second separation line 56.

Adhesive may be applied to the removable section 62 of the reinforcing panel to secure it to the back side of the display panel 32. In this manner the removable section 62 can be separated from the remainder 64 and removed as part of the single removable unit 60.

Bottom forming flaps 59*a*, 59*b*, 59*c* and 59*d*, integrally attached to the multiple side panels 12, form the bottom of the container 10. Numerous styles of bottoms and bottom forming flaps may be used. This includes crash-lock, RSC and other types of bottoms.

The container 10 is preferably made from corrugated paperboard as widely used in the art.

The container assembly 10 has a knockdown state 70 which is opened and folded to form the assembled container 10. The term "knockdown" refers to the flat unassembled assembly 70 as shown in FIG. 4 and which is easily opened to form the assembled and closed container shown in FIG. 1.

The container 10 can be easily manufactured in the knockdown state 70. Because they are flat, knockdowns are conveniently bundled and shipped to the packager for quick assembly into the assembled container 10 using automated equipment.

Figure 1A:
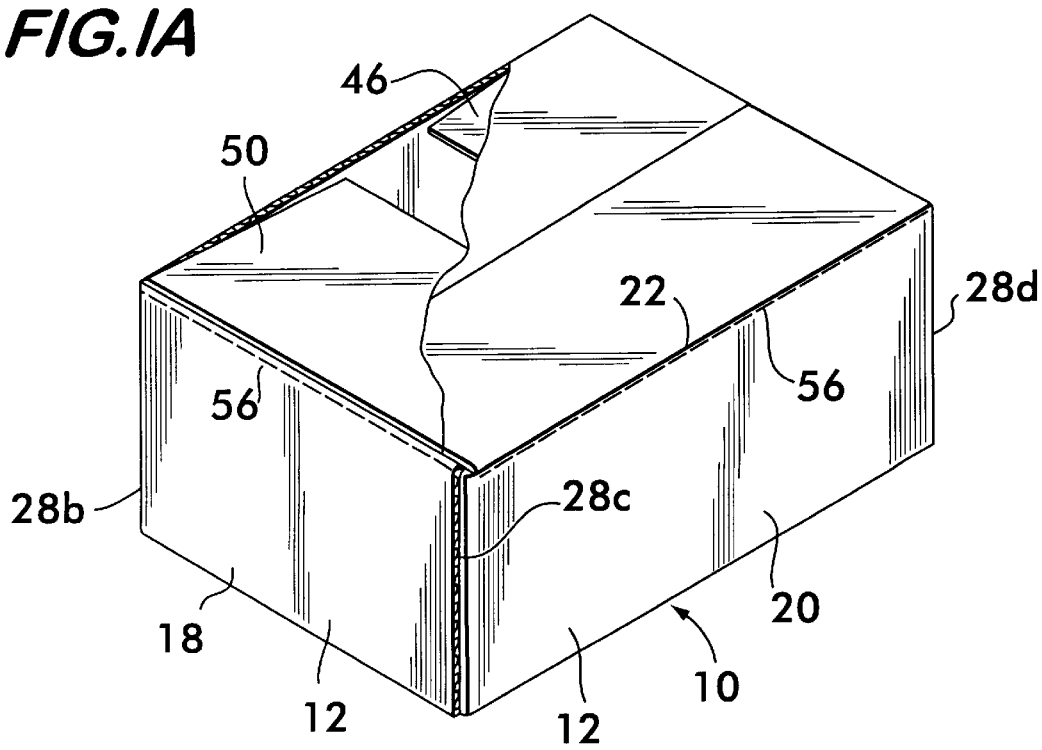
FIG. 1A is a perspective view of the back side of the container shown in FIG. 1.

Referring to FIGS. 4, 1 and 1A, the knockdown 70 has a first flat side 72 and a second flat side 74 attached to each other at opposite ends at corners 28*a*, 28*c* as shown. These corners correspond to the same corners 28*a*, 28*c* of container 10 shown in FIGS. 1 and 1A. The flat walls 72 and 74 include the side panels 12 that will form the final container 10. In the illustrated embodiment, the first flat wall 72 includes the first and second side panels 14,16 and the top flaps 46, 48 in a substantially same plane. It is understood that "substantially same plane" does not mean exactly the same plane. Likewise, the second flat wall 74 includes the third and fourth side panels 18, 20 and top flaps 50, 52 all in a substantially same plane which is substantially parallel to the plane for the first flat wall 72. The bottom forming flaps 59*a*–59*d* are likewise divided among the two knockdown walls as shown. The reinforcing panel 30 is sandwiched between and substantially parallel to the knockdown walls 72 and 74 as shown in FIG. 4 (visible through the opening 42).

To assemble the knockdown 70 into the fully assembled shipping/display container 10, the two knockdown flat walls 72 and 74 are pushed apart, folding the flat walls 72 and 74 to form the corners 28*a*, 28*c* and create the basic shape of the container 10 as seen in FIG. 1. The container bottom is then assembled folding the bottom forming flaps 59*a*–59*d* as known in the art. An example of a knockdown is disclosed in U.S. Pat. No. 5,505,368 to Kanter, et al. which is hereby incorporated by reference.

Figure 5:
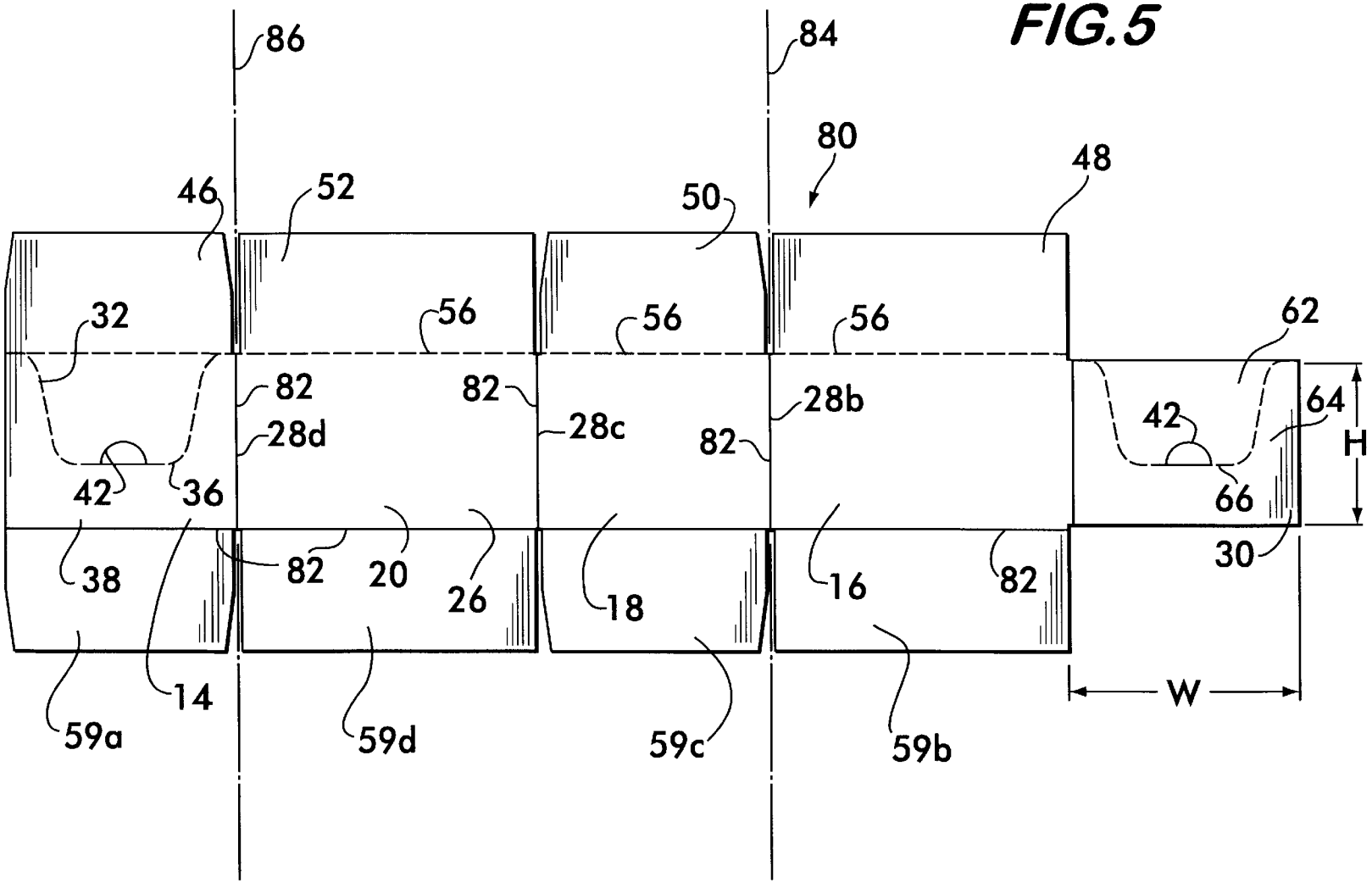
FIG. 5 illustrates a blank which can be assembled into the knockdown state shown in FIG. 4.

Illustrated in FIG. 5 is a blank 80 for forming the container assembly 10 having the knockdown state 70 as shown in FIG. 4 and the fully assembled state as shown in FIG. 1. The blank 80 is a die-cut unitary piece of corrugated paperboard having integrally attached first, second, third and fourth side panels 14, 16,18 and 20 and first, second, third and fourth top flaps 46, 48, 50 and 52 integrally attached to respective side panels as shown. The side panels 14, 16, 18 and 20 are separated by fold lines 82 (score lines). Bottom flaps 59*a*, 59*b*, 59*c* and 59*d* are integrally attached to respective side panels as shown and separated therefrom by fold lines 82 (score lines).

The first separation line 36 comprising perforations as shown is formed into the first side panel 14. The third separation line 56 is formed along the top edge of the second, third and fourth side panels 16, 18 and 20 as shown. The hand openings 42 are cut into the blank 80 for both the first side panel 14 and the reinforcing panel 30.

The reinforcing panel 30 is integrally connected to the fourth side panel 16 and thus part of the unitary blank. It is seen that in the present embodiment, the reinforcing panel 30 is substantially the same width (W) and height (H) as the first side panel 14 to which it is secured, although slightly less in dimension to insure it fits in the inside of the assembled container 10.

The fold lines 82 may take any suitable form as known in the art, score and crease lines being preferable. The blank 80 can be assembled into the knockdown 80 during manufacture. With the blank 70 in a flat position as shown in FIG. 5, the side panel 16, the reinforcing panel 30, the top flap 48 and bottom flap 59*b* are folded as a flat unit about the line 84 onto the inner face 26 of the other side panels of blank 80 to create the corner 28*b*. The side panel 14 with the top flap 46 and bottom flap 59*a* is then folded as a flat unit about the line 86 onto the reinforcing panel 30 thereby forming the corner 28*d*. The side panel 14 is glued to reinforcing panel 30. It is seen that this readily forms the knockdown 70 shown in FIG. 4 with the reinforcing panel 30 sandwiched between the knockdown walls 72 and 74.

As described above with reference to the preferred embodiment, the present invention provides a new and novel economical means of increasing the compression strength of display containers having side panels weakened by separation lines such as those formed by perforations. The reinforcing panel 30 requires minimal additional material and is easily formed as part of the unitary blank with minimal modification of the manufacturing line.

While particular embodiments of the invention are described herein, it is not intended to limit the invention to such disclosure. Changes and modifications may be incorporated and embodied within the scope of the appended claims.

What is claimed is:

1. A container assembly comprising:

multiple side panels attached to one another, said multiple side panels including a first side panel having an inner face and a top edge, and a second side panel adjacent to said first panel;

a removable display panel formed in and part of said first side panel, said display panel having an upper edge defined by at least a portion of the top edge of said first side panel and further defined by a first separation line along which said display panel is separable from a remainder of said first side panel;

a container top including a first top flap integrally attached to said first side panel at said top edge;

a removable top section including at least a portion of said first top flap, said removable top section being integrally attached to said upper edge of said display panel;

at least one bottom forming flap; and a reinforcing panel positioned in overlapping relationship with at least a portion of said first separation line, said reinforcing panel having a removable section and a remainder section separable from one another along a second separation line, said remainder section of said reinforcing panel being integrally connected to said second side panel and adhesively secured to the inner face of said first side panel.

2. A container in accordance with claim 1 wherein said removable top section includes a third separation line, said third separation line having end portions joining said first separation line.

3. A container in accordance with claim 1 wherein said first and second separation lines comprise perforations.

4. A container in accordance with claim 3 wherein said reinforcing panel has a height substantially equal to a height of said first wall panel.

5. A container in accordance with claim 3 wherein said reinforcing panel has a width substantially equal to a width of said first wall panel.

6. A container in accordance with claim 1 wherein said remainder section of said reinforcing panel has an edge connected integrally to an edge of said second side panel.

7. A container in accordance with claim 1 wherein said remainder section of said reinforcing panel is secured to said remainder of said first side panel.

8. A container in accordance with claim 1 wherein said removable section of said reinforcing panel is secured to and removable with said display panel.

9. A container in accordance with claim 7 wherein said removable section of said reinforcing panel is secured to said display panel.

10. A container in accordance with claim 9 wherein said remainder section of said reinforcing panel is secured to said remainder of said first side panel with an adhesive.

11. A container in accordance with claim 1 wherein said container top further includes a second, third and fourth top flap, each of said second, third and fourth top flap being integrally attached to the upper edge of said multiple side panels, said removable top section including at least a portion of said second, third and fourth top flaps and further includes a third separation line dividing said second, third and fourth top flaps from said multiple side panels, said second separation line having end portions joining said first separation line.

12. A container in accordance with claim 11 wherein said separation lines comprises perforations.

13. A container in accordance with claim 9 wherein said reinforcing panel has a height substantially equal to a height of the first side panel.

14. A container in accordance with claim 13 wherein said reinforcing panel has a width substantially equal to a width of the first side panel.

15. A container in accordance with claim 1 wherein said first side panel and said reinforcing panel include handle openings.

16. A container assembly comprising:

multiple side panels attached to one another and having a top edge and an inner face, said multiple side panels including a first side panel and a second side panel adjacent to said first side panel;

a removable display panel formed in said first side panel, said display panel having an upper edge defined by at least a portion of the top edge of said first side panel and further defined by a first separation line along which said display panel is separable from a remainder of the first side panel;

a reinforcing panel having a removable section and a remainder section separated from one another by a second separation line, said remainder section being integrally attached to an end of said second side panel and secured adhesively to said inner face of said first side panel;

a first top flap integrally attached to said display panel, and a second top flap integrally attached to one of said multiple side panels;

a removable top section which includes at least a portion of said first and second top flaps, said removable top section being at least partially separable from said container along a third separation line.

17. A container comprising:

multiple side panels attached to one another and having a top edge and an inner face, said multiple side panels including a first side panel and a second side panel adjacent to said first side panel;

a removable display panel formed in said first side panel, said display panel having an upper edge defined by at least a portion of said top edge of said first side panel and further defined by a first separation line along which said display panel is separable from the remainder of the first side panel;

a reinforcing panel having a removable section and a remainder section separated from one another by a second separation line, said remainder section being integrally attached to and end of said second side panel and secured adhesively to an inner face of said first side panel;

top flaps integrally attached to said multiple side panels, said top flaps including a first, second, third, and fourth top flap, said first top flap integrally attached to said first side panel; and a removable top section which includes at least a portion of said first top flap, said removable top section being defined at least partially by a third separation line which has end portions joining said first separation line.

18. A container in accordance with claim 17 wherein said second separation line is configured to match a curvature and position of said first separation line.

19. A container in accordance with claim 17 wherein said top section includes at least a portion of said second, third and fourth top flaps.

* * * * *